United States Patent [19]

Rattigan et al.

[11] Patent Number: 5,036,436

[45] Date of Patent: Jul. 30, 1991

[54] TASK LIGHT

[75] Inventors: Paul M. Rattigan, 151 Circuit St., Norwell, Mass. 02061; Thomas M. Lemons, Marblehead, Mass.

[73] Assignee: Paul M. Rattigan, Norewell, Mass.

[21] Appl. No.: 538,259

[22] Filed: Jun. 14, 1990

[51] Int. Cl.[5] ..... A61G 13/00; F21V 7/12

[52] U.S. Cl. ..... 362/33; 362/217; 362/255; 362/260; 362/296; 362/341

[58] Field of Search ..... 362/33, 255, 256, 217, 362/260, 347, 349, 296, 341

[56] References Cited

U.S. PATENT DOCUMENTS

| | | | |
|---|---|---|---|
| 3,377,482 | 4/1968 | Podany | 362/255 |
| 3,732,416 | 5/1973 | Audesse et al. | 362/260 |
| 4,186,431 | 1/1980 | Engel et al. | 362/255 X |
| 4,414,609 | 11/1923 | Shemitz | 362/33 |
| 4,432,044 | 2/1984 | Lautzenheiser | 362/256 X |
| 4,947,303 | 8/1990 | Gordin et al. | 362/256 X |

*Primary Examiner*—Ira S. Lazarus
*Assistant Examiner*—Peggy A. Neils
*Attorney, Agent, or Firm*—Iandiorio & Dingman

[57] ABSTRACT

A task light including an aperture fluorescent lamp, a housing surrounding the lamp and having an opening aligned with the lamp aperture, and a reflector on one side of the housing opening for redirecting light back to the plane of illumination of the lamp to create a longer, more uniform illumination field for evenly illuminating a subject and acting as a direct-glare preventing visor.

11 Claims, 5 Drawing Sheets

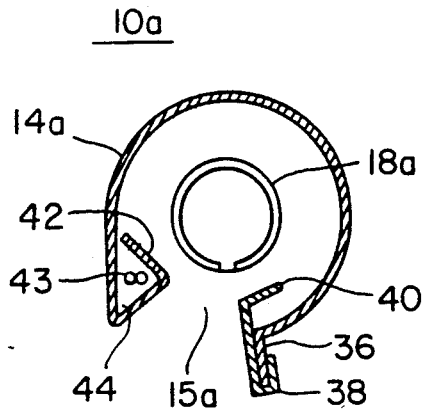
Fig. 3A
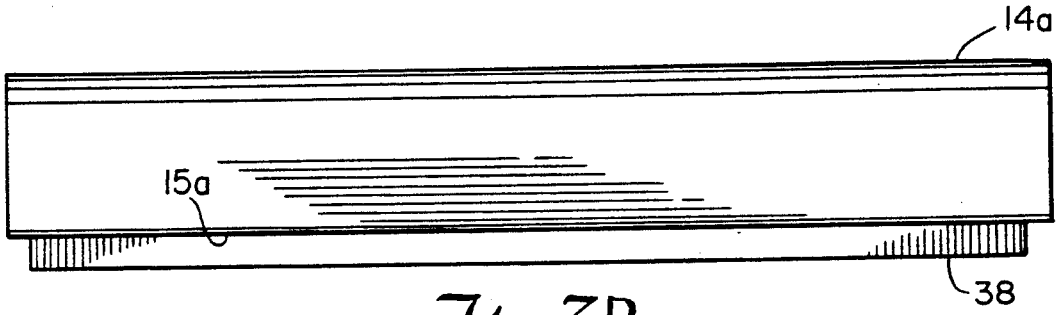
Fig. 3B
Fig. 4A
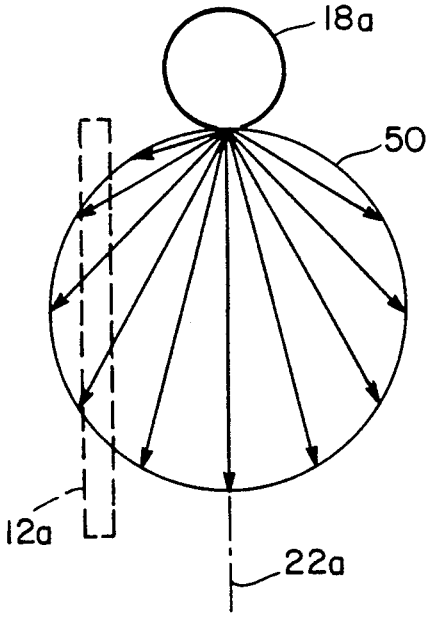
Fig. 4B
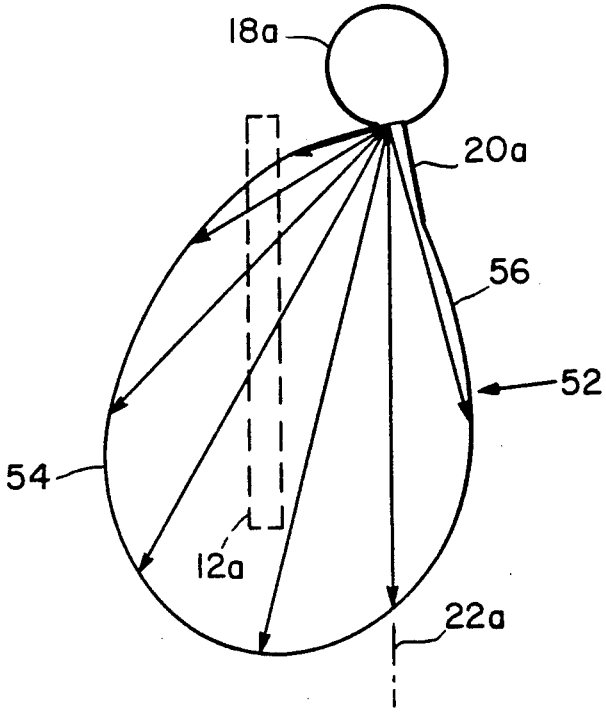

TASK LIGHT

FIELD OF INVENTION

This invention relates to a task light employing an aperture lamp for even, glare free lighting.

BACKGROUND OF INVENTION

Several trends have developed in lighting design to reduce the cost of interior lighting. The standard solution of brightly lighting an entire work environment has given way to more localized illumination of critical work areas with what may be termed task lights.

When used alone, ambient overhead lighting typically requires two to four watts per square foot for the efficient performance of most visual tasks. Task lights, on the other hand, serve to bring a concentrated and appropriate quality of light to specific areas in a manner that is conducive to comfort and productivity—and at half the energy cost. Combinations of task/ambient illumination reduces the wattage requirement below two watts per square foot.

Task lights are frequently used for lighting flat surfaces of either a horizontal or vertical orientation. Some examples of horizontal orientation are desks and tables, clerical and manufacturing work stations, and drawing boards. Typical vertical orientations include sheet music on stands and on pianos, and vertical document holders used in conjunction with Visual Display Terminals.

Horizontal work surfaces are frequently lit with incandescent or fluorescent task light sources positioned a foot or more above said surface. To provide sufficient light from that distance the lamp must be a relatively high wattage (e.g. 75 to 150 watts), with a substantial portion of the light spilling beyond the intended area of illumination. Additionally, a light source so directed will cause a significant amount of reflective glare.

The position of a task light is very critical to achieve acceptable uniformity of illumination over the task surface while also eliminating glare. A light placed directly over or in front of a task will provide uniform illumination but reflections in the surface will produce glare. This can be visualized by replacing the task with a mirror and if the person viewing the task sees the light in the mirror then reflected glare will occur. To address this issue, the task light must be placed well above, below or to the sides of the task to eliminate any direct reflection in the task surface. This oblique angle of light to the task and the close proximity of one side of the task to the light will result in non-uniform illumination. Providing light from two sides will produce acceptable uniformity and their placement can be chosen to eliminate reflected glare. Two units, however, increase cost and wattage while limiting versatility of the system performance under some user conditions.

The color quality of the illumination provided by the task light is an important consideration. The incandescent lamp and recently the tungsten halogen version of the incandescent lamp have been well received as the source used in task lights. These lamps provide a warm full color rendition that meets user quality concerns for task lights. In the past, attempts to replace the incandescent lamp with the more energy efficient fluorescent lamp have not been well received due to lamps being cooler and providing poor color rendition. Recent developments of tri phosphor fluorescent lamps have reversed this condition by making warm color fluorescent lamps that have a high color rendition as an available option. Such lamps can now be used in task lights to provide a more efficient means of supplying task illumination.

Piano sheet music is commonly lit with a desk-type lamp from above the music to minimize glare at the expense of good light distribution. There may be a drastic fall-off of light levels from the top to the bottom of the sheet music. Such a fall-off may be in the the range of from four to six:one. As a result, the music is difficult to read. Alternately, a floor lamp is sometimes placed behind the player for more uniform distribution, but with the angle of illumination resulting in uncomfortable levels of reflective glare.

The traditional light sources mentioned above possess a common limitation—they are incapable of providing the relatively even, glare-free lighting so desired.

One proposed solution to the piano music lighting problems was to use an aperture fluorescent lamp to light the music. In this arrangement, an extremely long lamp—required to be at least twice as long as the maximum distance from the lamp to the far side of the area to be lit—was mounted below the sheet music and the light-emitting aperture directed up onto the music. With a lamp at least twice as long as the height of the sheet music, or about thirty-six inches, the aperture lamp would theoretically provide sufficient light over the whole surface of the music. However, the extreme length of the lamp made it unsightly and difficult to mount below the music, much less over the music. In addition, the brightness of the long slot-shaped light emitting aperture caused problems with glare. As a result, the arrangement did not prove successful.

SUMMARY OF INVENTION

It is therefore an object of this invention to provide a task light for uniform, glare-free lighting of the subject.

It is a further object of this invention to provide such a light which can uniformly illuminate a relatively broad area at an acute angle to prevent glare.

It is a further object of this invention to provide such a light which accomplishes even light distribution with a low wattage lamp.

It is a further object of this invention to provide such a light which can adequately and uniformly light an area from only one side.

It is a further object of this invention to provide such a light which may employ a tri-phosphor lamp for warm color and good color rendition.

It is a further object of this invention to provide such a light in which the lamp need not be wider than the subject being lit.

It is a further object of this invention to provide such a light which is extremely energy efficient.

This invention results from the realization that a truly effective task light may be accomplished with an aperture lamp and a reflector mounted adjacent the aperture for reflecting the image of the aperture from one side of the aperture axis back toward the other side of the axis to create a long, uniform field of light for uniform, low wattage, glare-free lighting of subjects.

This invention features a task light including an aperture fluorescent lamp having a light emitting aperture along its length, lamp housing substantially surrounding the lamp and having an opening essentially in line with the aperture, and a reflector proximate and on one side of the housing opening for redirecting light back to the plane of illumination of the lamp to create a longer, more uniform illumination field for evenly lighting the subject. Preferably, the reflector is angled from 0° to 15°, with 15° being a preferred angle for a reflector strip on a music stand light using an 18° lamp aperture angle. Preferably, the reflector is approximately the same length as the lamp, at least as wide as the lamp aperture, and is attached to the housing. The reflector may extend into the housing and through the opening and may include a portion parallel to an arc of the lamp to act as a lamp guide.

The housing may also integrally include a wiring channel which may also act as a lamp guide. Preferably, the aperture lamp has an aperture of from 18° to 45°.

DISCLOSURE OF PREFERRED EMBODIMENT

Other objects, features and advantages will occur to those skilled in the art from the following description of a preferred embodiment and the accompanying drawings, in which:

FIGS. 3A and 3B are more detailed cross-sectional and side views of the aperture light of FIG. 1;

FIG. 4A is a representation of the illumination field around an aperture lamp;

FIG. 4B is a similar representation of the illumination field of the task light according to this invention;

Figure 1:
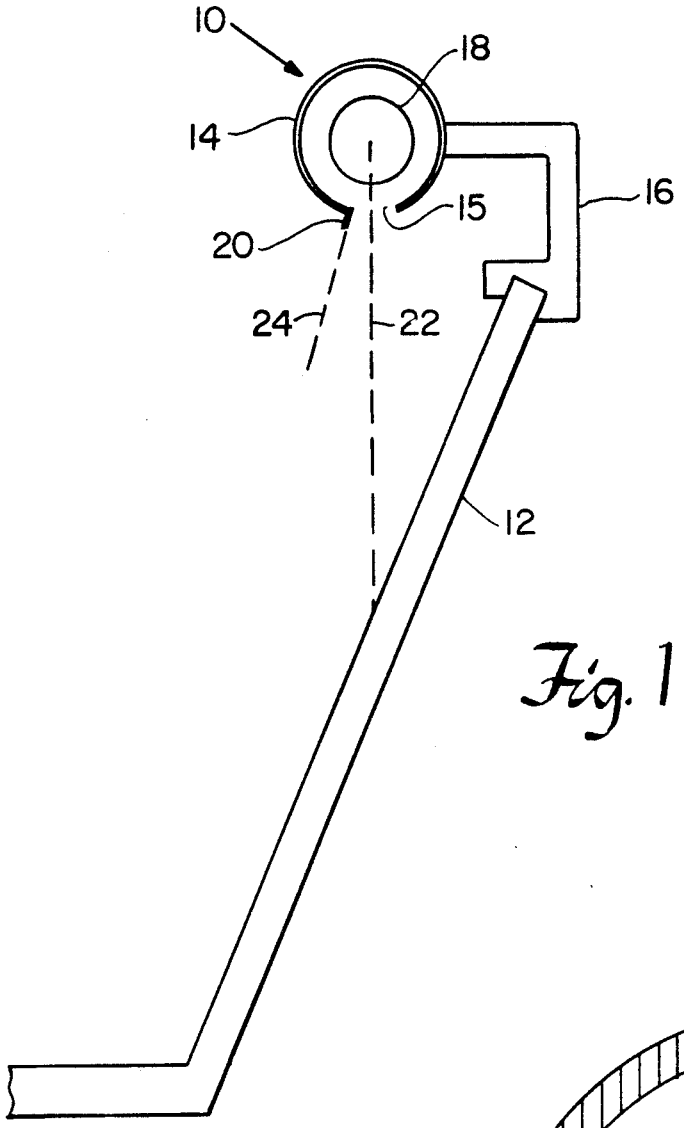
FIG. 1 is a side, schematic, partly cross-sectional view of a task light according to this invention mounted to a piano music stand.

There is shown in FIG. 1 task light 10 according to this invention mounted by mount 16 to piano music stand 12. Light 10 includes aperture fluorescent lamp 18 within cylindrical housing 14 having opening 15, which is typically coaxial with axis 22 of the lamp aperture. Light 10 includes reflector strip 20 mounted to housing 14 adjacent and along the length of opening 15 for directing a reflected image of the aperture down toward the lower section of stand 12 to uniformly light the music, as is more fully described below.

Figure 2:
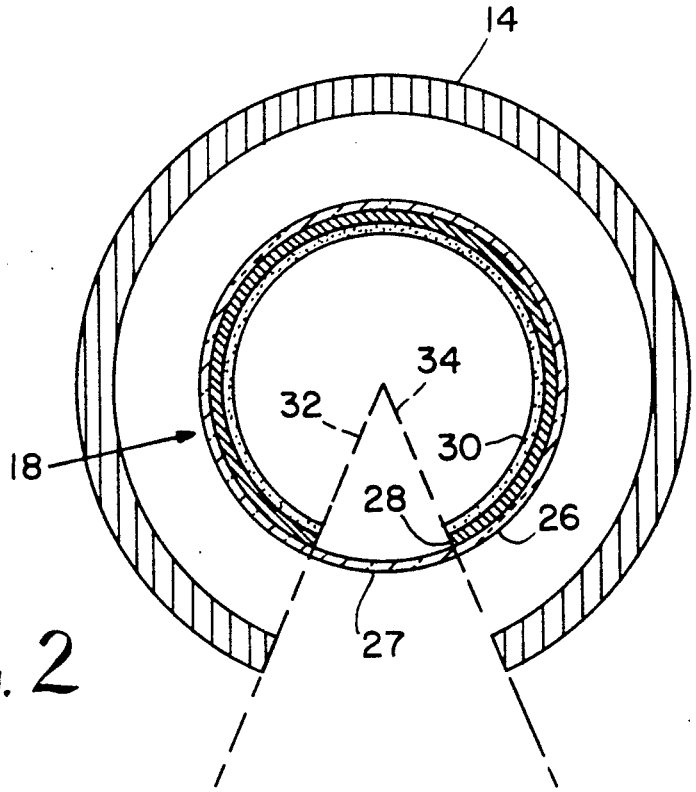
FIG. 2 is an enlarged, cross-sectional view of the aperture lamp and housing of the aperture light of FIG. 1.

Housing 14 and lamp 18 are shown in enlarged cross-sectional detail in FIG. 2. Aperture lamp 18 includes clear glass bulb 26 coated with a reflective coating 28 and phosphor coating 30 thereon. Lamp aperture 27 is defined by axis 3 and 34.

The amount of light, and the light distribution, from lamp 18, is affected by the size of aperture 27 since the aperture does not have the light-emitting phosphor coating 30. The size of the aperture is also related to the size of the illuminated field. Thus, it is important to choose a lamp and aperture which creates, in conjunction with the reflector strip more fully described below, a broad and uniform field of light for a designated task.

One embodiment of task light 10*a* according to this invention is shown in FIG. 3A, in which housing 14*a* includes radially extending tab 36 for defining one side of opening 15*a*, and also serving as a mounting flange for reflective strip 38, which includes portion 40 for both reflecting light and guiding the placement of lamp 18. Tab 36 also serves the dual purpose as a visor to reduce possibility of direct glare from the lamp. Folded over portion 42 of housing 14*a* also acts as a lamp-guide and provides a trough along the length of the housing for running lamp wiring 43 inside the housing. FIG. 3B illustrates that reflector strip 38 preferably runs the length of housing opening 15*a* to reflect most of the light on one side of the lamp axis back toward the other side.

The broad and uniform light distribution from the task light of this invention is illustrated by comparing FIGS. 4A and 4B. FIG. 4A illustrates the uniform lighting field 50 surrounding 15 degree T5 aperture lamp 18*a* having aperture axis 22*a*. As can be seen, since lamp 18*a* is being used only to light the surface of stand 12*a*, fully one-half of the illumination field is effectively not used. As a result, the light is concentrated toward the top of the music; the lighting at the bottom of the music is insufficient. To date, the only solution to this problem has been to provide a lamp which is at least twice as long as the height of the subject being lit in order to provide a field 50 which covers the entire subject.

Such an arrangement is wholly unnecessary with the task light of this invention, partially shown in FIG. 4B. By including reflective strip 20*a* proximate the aperture of lamp 18*a*, the illumination field 52 on the side of lamp axis 22*a* away from the subject being lit 12*a* is reflected back toward the other side 54 of the illumination field, and toward the bottom of the field, to lengthen field 54 so that it reaches the bottom of the area being lit, in this case the music on stand 12*a*. Since the field is long enough to light the subject, lamp 18*a* need only be as long as the subject being lit. Thus, for example, in lighting sheet music, the lamp need only be as long as the open book—typically eighteen inches. As a result, the light is easy to mount and very non-obtrusive.

As known to those skilled in the art, the performance of aperture lamps has been found to vary based upon the aperture angle and reflectance of the coating of the bulb. A lamp that is coated with an 80% to 90% reflectance coating and then the phosphor which has an aperture angle of about 60 degrees has been found to produce the greatest directional intensity. Wider apertures produce reduced intensity and wider spread of light; narrower apertures produce a narrower spread of light while also reducing the directional intensity.

Figure 5:
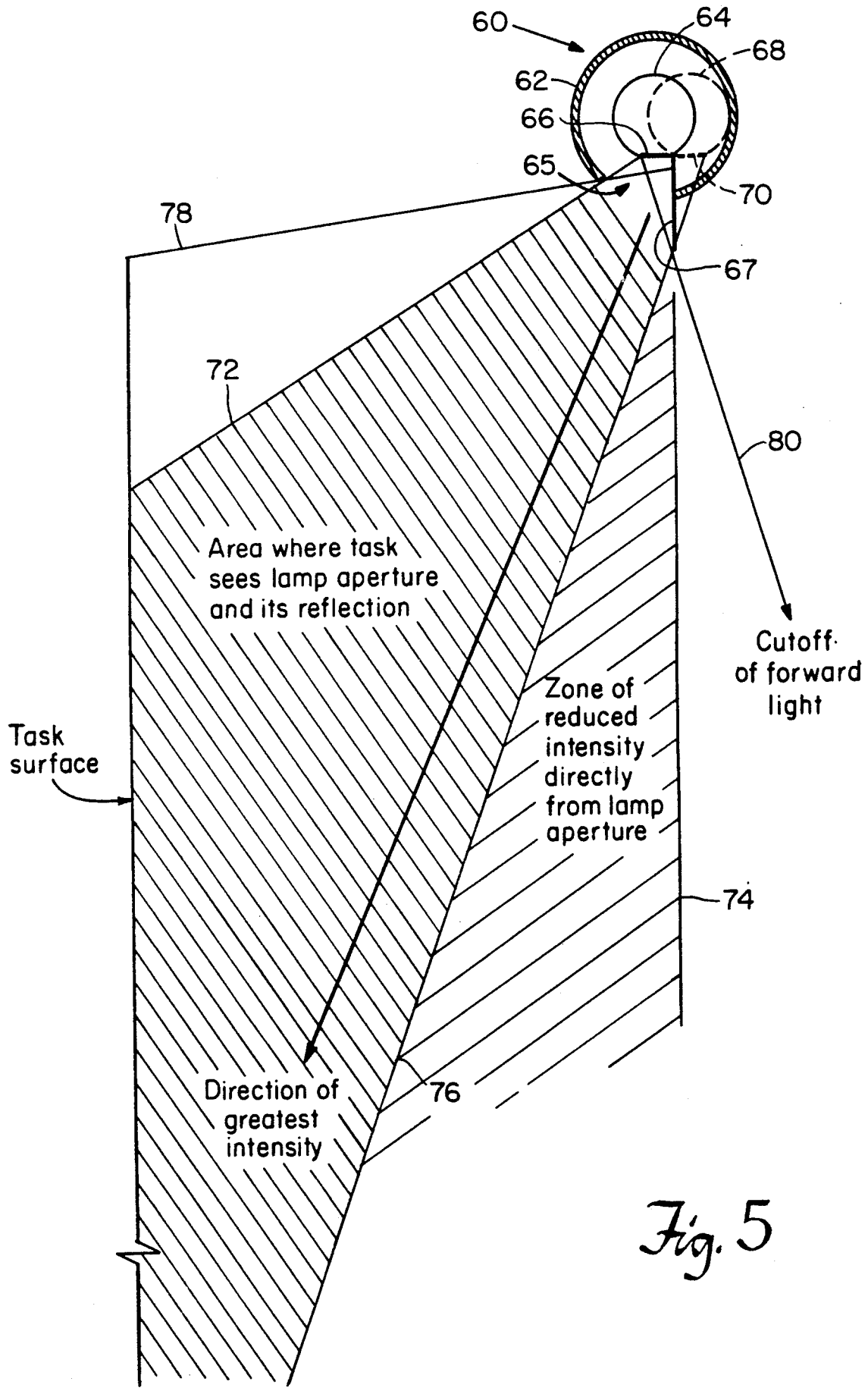
FIG. 5 is a schematic diagram of a task light of this invention lighting a vertical task surface, showing the light distribution from the lamp and reflector combination.
Figure 6:
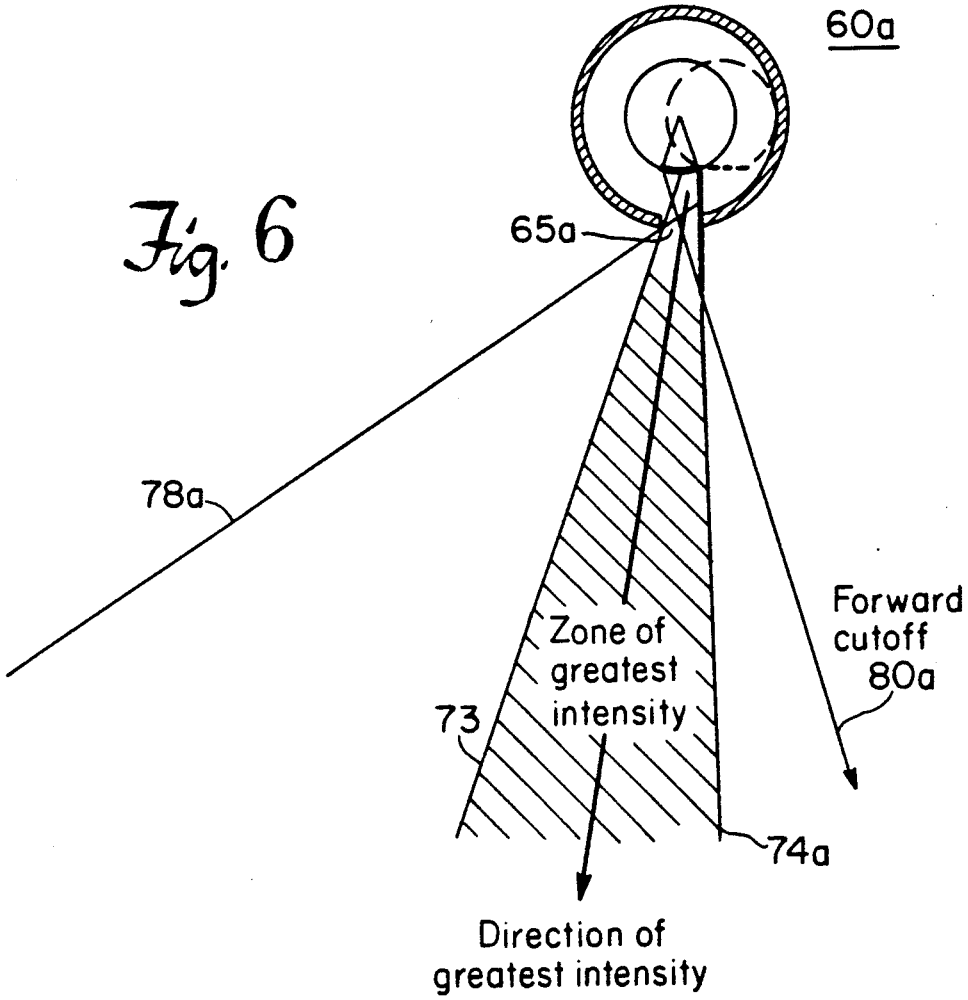
FIG. 6 is a similar schematic for a task light with a smaller housing opening for directing more light downward.
Figure 7:
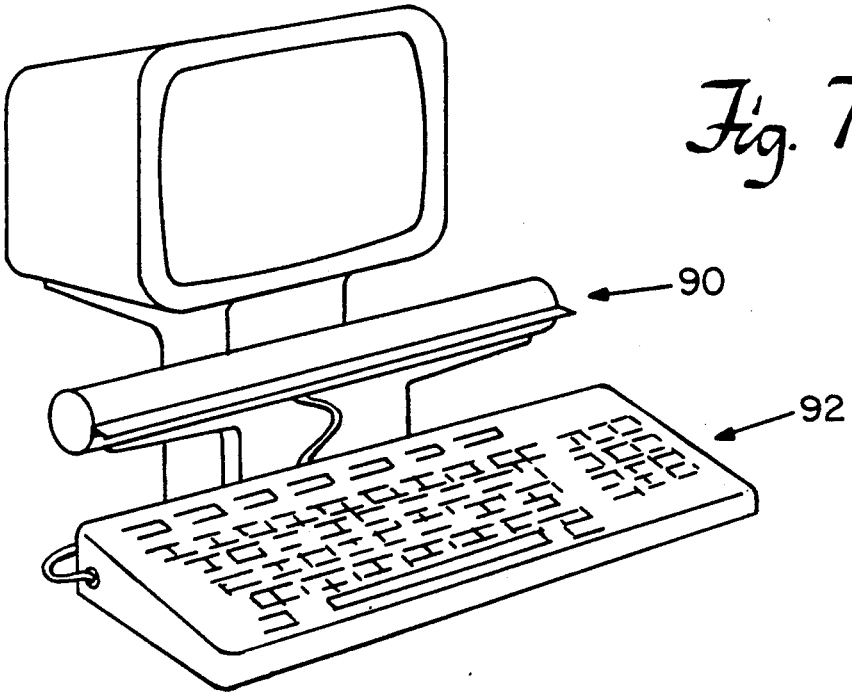
FIGS. 7–10 illustrate several applications of the task light of this invention.
Figure 8:
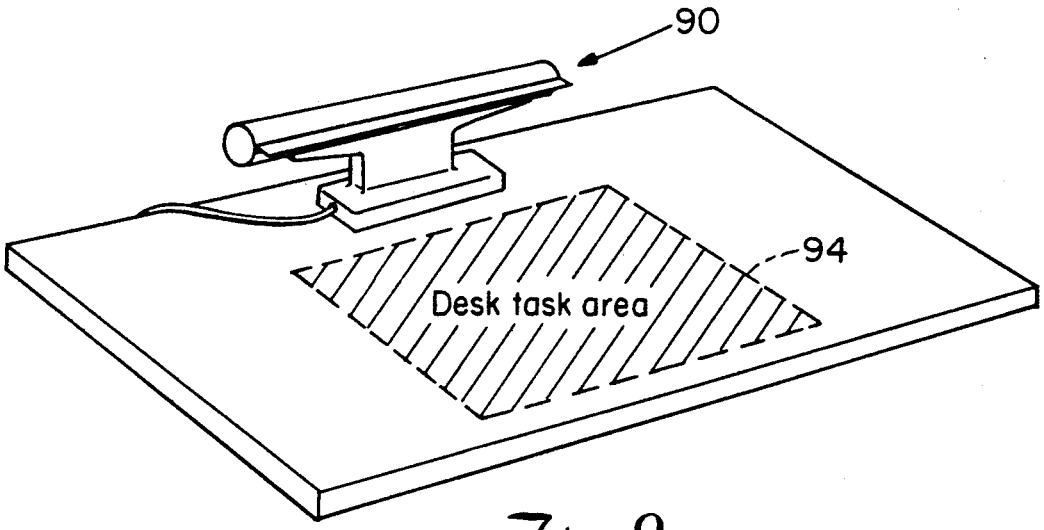
Figure 9:
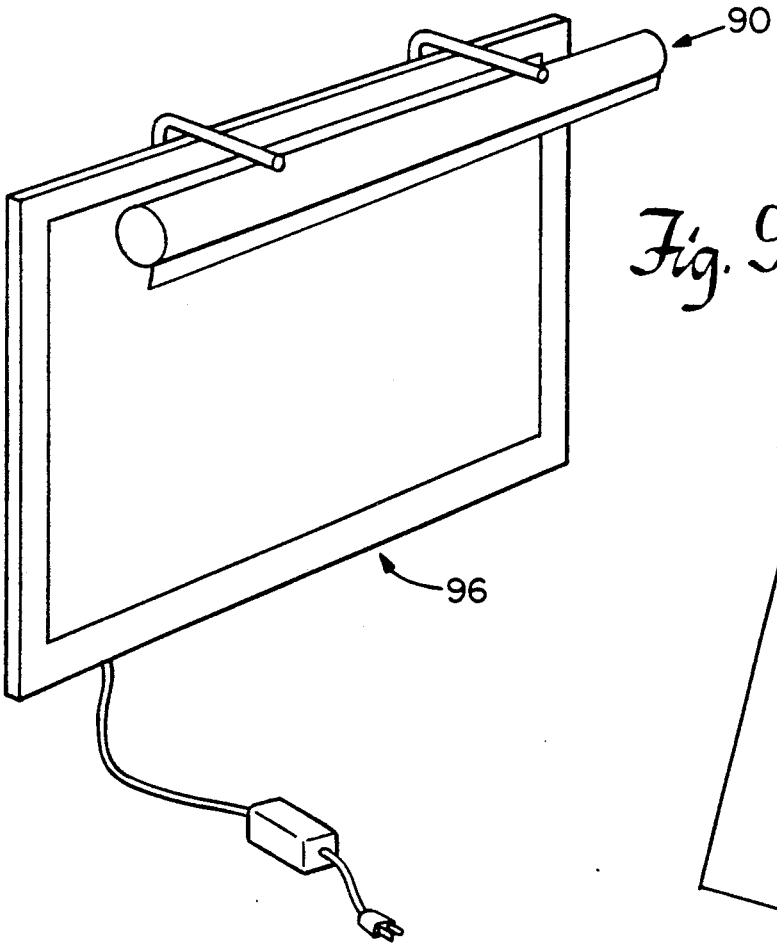
Figure 10:
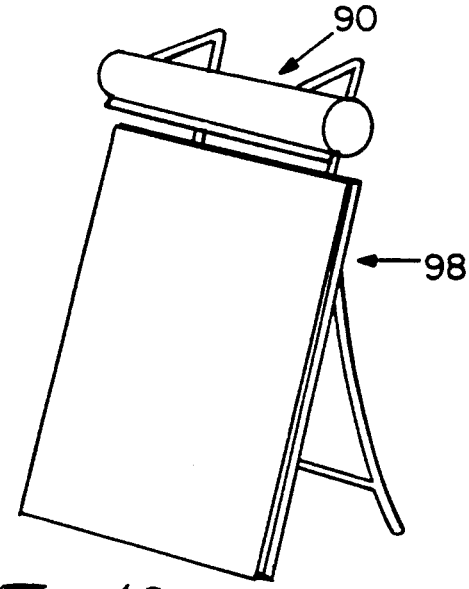

The housing which contains the aperture lamp restricts the spread of light along the axis of the two apertures, as illustrated by zone 73 in FIG. 6. It will drastically reduce the spread of light that would otherwise be available from the aperture. The device of this invention provides for the restriction of light to one side (towards the user) while directing light towards the music or task. Mirror surface 67, FIG. 5, that extends from the front edge of the aperture straight down parallel to the task surface and facing the task will redirect light back onto the task. This mirror surface will almost double the intensity of light directed down out of the lamp by giving the appearance that a second aperture 70, shown in phantom, is adjacent to the actual lamp aperture 66. For this to occur, the lamp aperture 66 must be limited to 5% to 12.5% (18° to 45°) of the circumference of the lamp and the width of the mirror 67 must be greater than the width of the aperture.

As illustrated in FIG. 5, the wide housing opening 65 and a wide lamp aperture (45°) produces a wide beam and a high intensity of light directed to the bottom of the task. A narrow housing opening 65*a*, FIG. 6, and 45° lamp aperture will reduce the maximum directional intensity and also reduce the beam spread. Further spread reductions would be obtained from a narrower lamp aperture and corresponding housing opening reduction. (The housing opening should never be narrower than the lamp aperture.) A narrow lamp aperture will provide reduced lumen output as well as directional intensity but it could produce a more uniform task illumination. The trade-off to achieve uniform task area illumination involves varying the lamp aperture size and the housing opening as required to achieve the greatest intensity directed to the further task area while limiting the spread of light.

FIG. 5 illustrates light 60 with housing 62 having opening 65 aligned on one side with aperture 66 and wider than the aperture. Reflector 67 limits the spread of forward light to axis 80, and so acts as a visor to eliminate direct glare. Axes 74 and 78 define the lighting boundaries. Axes 76 and 72 define the area of greatest illumination in which there is included both directed and reflected light.

When the housing opening is the same size as the aperture, FIG. 6, there is a narrower zone of illumination, set forth by axes 80*a* and 78*a*. Area 73 has the greater illumination intensity, and may be directed toward the bottom of the task as shown. In that case, the reflected strip may be used to reflect light toward the top of the task rather than the bottom.

FIGS. 7 through 10 illustrate other applications of task light 92 of this invention, which is well suited for uniform and glare-free lighting of tasks such as keyboard 92, desk area 94, painting or wall hanging 96, and desk-top copyholder 90. The light is also particularly suited for lighting wall areas such a vanities, with a wall-wash effect, and task-oriented activities in the kitchen. The light is also well sutied for lighting lecturns.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A task light, comprising:

an aperture fluorescent lamp having a narrow elongated light-emitting aperture along its length for emitting a lighting field generally symmetrical around an aperture axis;

a lamp housing spaced from and substantially surrounding the lamp having an elongated opening at least partly aligned with the lamp aperture; and an elongated reflector proximate and along one side of said housing opening for redirecting light from one side back across the aperture axis to create an asymmetrical illumination field elongated on one side of said axis for more evenly lighting a task area, and for blocking forward light to reduce direct glare from the lamp.

2. The task light of claim 1 in which said reflector is angled a much as 15° from said aperture axis to direct light away from said housing.

3. The task light of claim 1 in which said reflector is approximately the same length as said lamp.

4. The task light of claim 1 in which said reflector is attached to said housing.

5. The task light of claim 4 in which said reflector extends into said housing through said opening.

6. The task light of claim 5 in which said reflector extending into said housing is parallel to an arc of said lamp to act as a lamp guide.

7. The task light of claim 1 in which said housing integrally includes a wiring channel.

8. The task light of claim 7 in which said wiring channel acts as a lamp guide.

9. The task light of claim 1 in which said lamp has an aperture of from 18° to 45°.

10. The task light of claim 1 in which said reflector is at least as wide as said lamp aperture.

11. A task light, comprising:

an aperture fluorescent lamp having an aperture approximately the length of an area to be illuminated for emitting a lighting field generally symmetrical around an aperture axis;

a housing surrounding and spaced from said lamp with a slot-shaped opening aligned with said aperture, said opening formed at least partially by a housing section extending radially away from said lamp; and a reflector member fixed to said extending housing section and at least as wide as aid aperture for reflecting light on one side of the aperture axis back toward the other side of the aperture axis and way from said housing to modify the light distribution from said lamp to create an asymmetrical field for more evenly lighting a subject on said other side of the aperture axis and reducing forward glare.

* * * * *